US005746075A

United States Patent [19]

Yang

[11] Patent Number: 5,746,075

[45] Date of Patent: May 5, 1998

[54] COMBINATION PADLOCK

[76] Inventor: Yaw-Kuen Yang, No. 190-30, Chang Shoei Rd., Chang Hua, Taiwan

[21] Appl. No.: 725,906

[22] Filed: Oct. 4, 1996

[51] Int. Cl.[6] ..... E05B 37/06

[52] U.S. Cl. ..... 70/25; 70/52; 70/312; 70/326

[58] Field of Search ..... 70/25, 312, 22, 70/24, 26, 51, 52, 315–318, 320, 323–326

[56] References Cited

U.S. PATENT DOCUMENTS

| | | | |
|---|---|---|---|
| 1,964,936 | 7/1934 | Denerich | 70/25 |
| 2,008,565 | 7/1935 | Segal | 70/25 |
| 2,183,168 | 12/1939 | Pond | 70/25 |
| 4,048,821 | 9/1977 | Bako et al. | 70/25 |
| 4,899,559 | 2/1990 | Chern | 70/25 |
| 4,907,430 | 3/1990 | Hong | 70/312 |
| 5,125,248 | 6/1992 | Ling | 70/25 |
| 5,520,032 | 5/1996 | Ling | 70/25 |

FOREIGN PATENT DOCUMENTS

| | | | |
|---|---|---|---|
| 2214559 | 9/1989 | United Kingdom | 70/312 |
| 2227515 | 8/1990 | United Kingdom | 70/25 |

*Primary Examiner*—Lloyd A. Gall
*Attorney, Agent, or Firm*—Browdy and Neimark

[57] ABSTRACT

A combination padlock comprises a housing, a shackle, and a numbered wheel set. The housing is made up of a front housing and a rear housing. The shackle has a hooked portion and a rod-shaped body. The numbered wheel set comprises a seat on which a locking mechanism is disposed for actuating a movable grid plate to move up and down. The front housing is provided with a receiving cell having a position restricting block, whereas the rear housing is provided with a receiving cell having a position restricting block and a retaining block. The position restricting block is intended to confine the rod-shaped body of the shackle while the retaining block is engageable with the retaining recess of the rod-shaped body of the shackle at such time when the shackle is pulled upwards.

2 Claims, 2 Drawing Sheets

COMBINATION PADLOCK

FIELD OF THE INVENTION

The present invention relates generally to a padlock, and more particularly to a combination padlock.

BACKGROUND OF THE INVENTION

The conventional combination padlock comprises a shackle which is secured to the lock body by means of one or more C-shaped retaining rings fastened to the periphery of the shackle or by means of a shaft pin disposed in a slide slot extending axially in the periphery of the shackle. Such a conventional combination padlock as described above is defective in design in that it is relatively complicated in construction, and that its body has to be designed specially to accommodate the C-shaped retaining rings or the shaft pin, and further that its numbered wheels can not be easily mounted when there are more than three numbered wheels.

SUMMARY OF THE INVENTION

It is therefore the primary objective of the present invention to provide a combination padlock with a shackle which can be fastened easily and pivotally with the housing of the combination padlock.

It is another objective of the present invention to provide a combination padlock with a series of the numbered wheels which can be mounted easily and rapidly.

The combination padlock of the present invention is composed of a housing, a shackle, and a numbered wheel set. The housing is made up of a front housing and a rear housing and is provided in the wall thereof with a slot and a pivoting hole. The shackle has a hooked portion and a body. The numbered wheel set comprises a seat on which a locking mechanism is located for actuating a movable grid plate to move up and down. The front housing is provided with a receiving cell having a position restricting block, whereas the rear housing is provided with a receiving cell having a position restricting block and a retaining block. The position restricting block is to confine the body of the shackle while the retaining block is engageable with a retaining recess of the shackle body.

The foregoing objectives, features and functions of the present invention will be more readily understood upon a thoughtful deliberation of the following detailed description of the present invention in conjunction with the accompanying drawings.

DETAILED DESCRIPTION OF THE INVENTION

Figure 1:
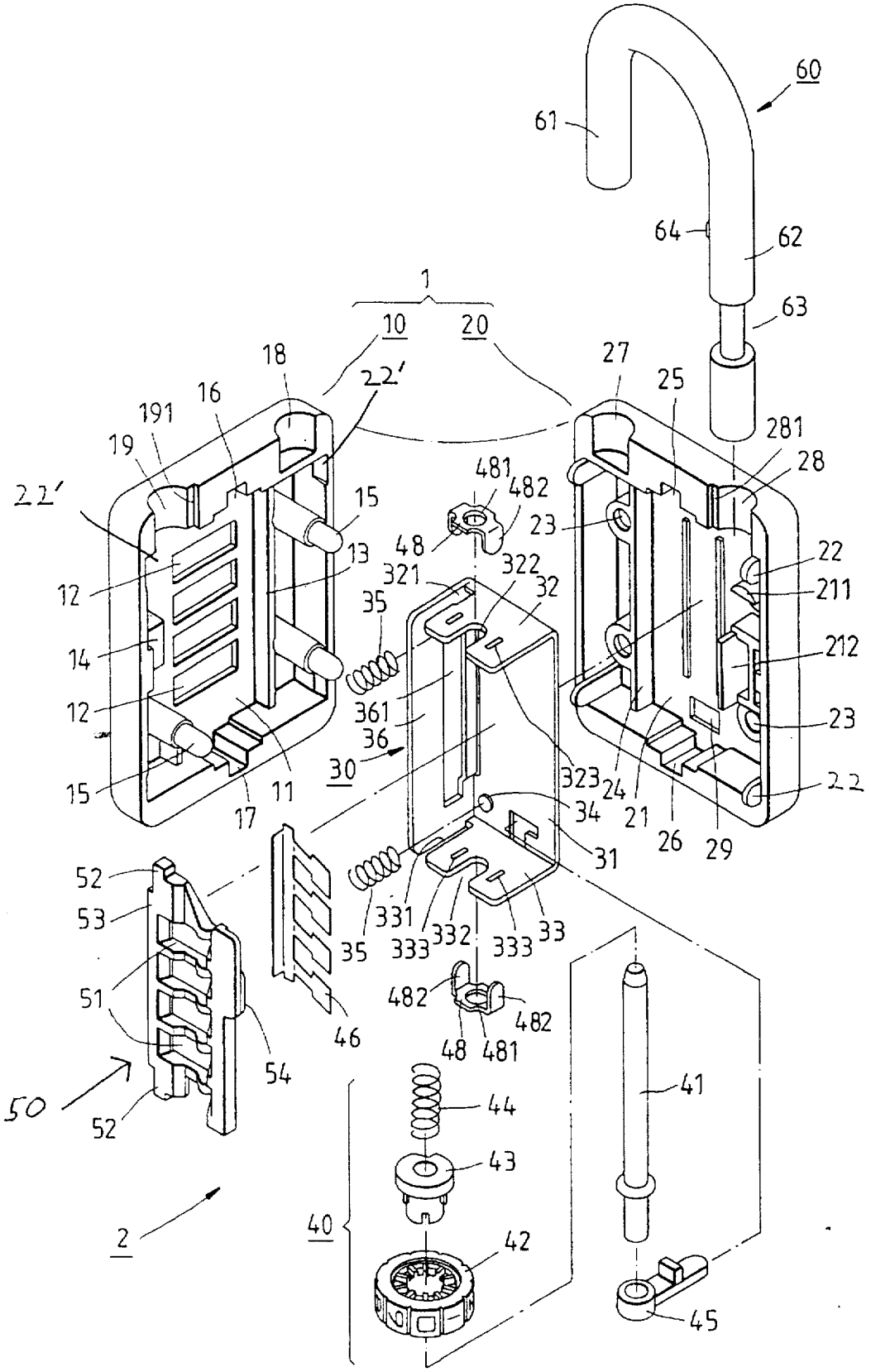
FIG. 1 shows an exploded view of the present invention.
Figure 2:
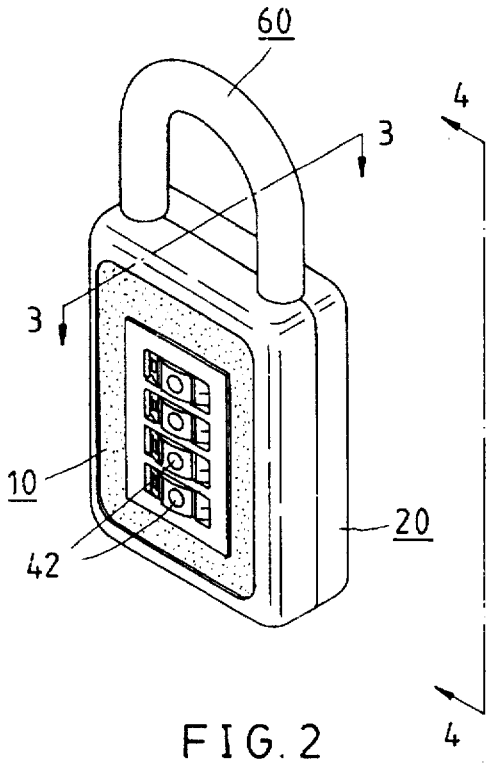
FIG. 2 shows a perspective view of the present invention in combination.

As shown in FIGS. 1 and 2, a combination padlock embodied in the present invention is composed of a housing 1, a numbered wheel set 2, and a shackle 60.

The housing 1 comprises a front housing 10 and a rear housing 20. The front housing 10 of a square construction is provided with a receiving cell 11 having four parallel through holes 12 which are located at the midsegment of the bottom of the receiving cell 11. A partition 13 and a position restricting block 14 are positioned at opposite sides of through holes 12. The receiving cell 11 is further provided on the bottom thereof with three fastening pins 15 and is still further provided between the upper and the lower side walls thereof with the pivoting slots 16 and 17. The front housing 10 is provided at both ends of the top thereof with a semicircular slot 18 and a pivoting hole 19. The pivoting hole 19 is provided in the inner wall thereof with a slide slot 191. The rear housing 20 corresponds to the front housing 10 and is provided respectively in the walls of the receiving cell 21 thereof with locating pins 22 which engaged recesses 22' on front housing 10 to assist in fitting the front and rear housing together; three stepped through holes 23 corresponding in location to the fastening pins 15 of the front housing 10. The rear housing 20 is still further provided with the partition 24, the pivoting slots 25 and 26, the recess 27 and the pivoting hole 28, which are respectively corresponding in location to the partition 13, the pivoting slots 16 and 17, the recess 18 and the pivoting hole 19. The pivoting hole 28 is provided in the inner wall thereof with a slide slot 281. The receiving cell 21 of the rear housing is provided in the bottom thereof with a retaining block 211 and a position restricting block 212. A square hole 29 is located over the pivoting slot 17.

The numbered wheel set 2 comprises a seat 30 made of a metal plate by punching and pressing. The seat 30 has a receiving space 31 with an open top and is provided respectively in the side walls 32 and 33 thereof with the pivoting slots 321, 331 and the shaft slots 322 and 332. The receiving space 31 is provided in the bottom thereof with the locating projection 34 for locating a spring 35. A long side wall 36 of the receiving space 31 is provided with a long cut 361. A combination lock mechanism 40 has four numbered wheels 42 and a cam 43, which are mounted on a rotary shaft 41. The rotary shaft 41 only one wheel and cam being shown in FIG. 1 is fastened with a compression spring 44 and a dial rod 45. Each numbered wheel 42 is urged at the bottom thereof by a retaining elastic piece 46 for actuating the numbered wheel to turn unidirectionally. Two fastening pieces 48 are provided respectively at the center thereof with a through hole 481 and at both sides thereof with two connection ribs 482. A movable grid plate 50 has four through slots 51, two pivoting portions 52 engaged with the pivoting slots 321 and 331, a stopping portion 53 engaged with the long slot 361 of the seat 30. A retaining portion 54 is engaged with the shackle 60. The movable grid plate 50 has a bottom urging the spring 35 of the seat 30. The through slots 51 are intended to secure the numbered wheels 42. Both ends of the rotary shaft 41 are received in the shaft slots 322 and 332, whereas the through holes 481 of the fastening pieces 48 are engaged pivotally with both ends of the rotary shaft 41. The connection ribs 482 are engaged with the connection slots 323 and 333 of the side walls 32 and 33 of the seat 30. As a result, the rotary shaft 41 is received securely in the shaft slots 322 and 332.

The shackle 60 has a curved hook portion 61 and a straight rod body 62 which is provided with a retaining portion 63 having a protuberance 64.

In combination, the hook portion 61 and the body 62 of the shackle 60 are located respectively on the recess 27 and the pivoting hole 28 of the rear housing 20 such that the bottom periphery of the body 62 is located between the position restricting blocks 14, 212. Thereafter, the numbered wheel set 2 is received between the partition 24 and the position restricting block 212 of the rear housing 20. The front housing 10 is than joined with the rear housing 20 such that the fastening pin 15 of the front housing 10 remain at the outside of the stepped through hole 23 and locating pins 22 are engaged 22'.

Figure 4:
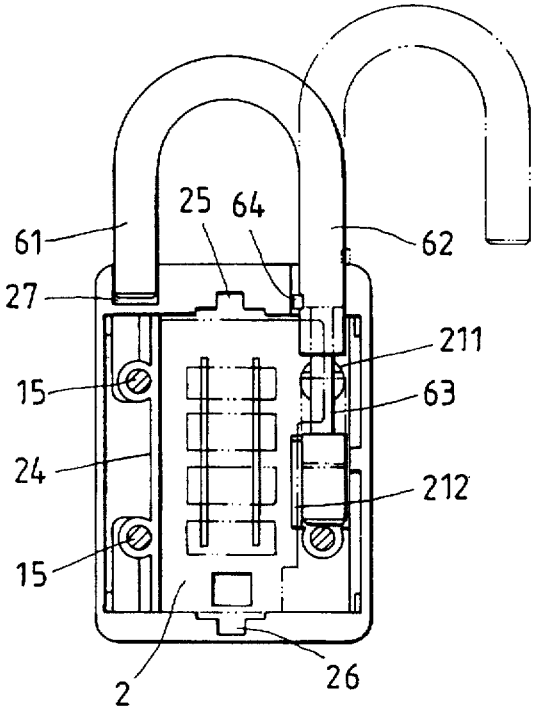
FIG. 4 shows a sectional view of a portion taken along the direction indicated by a line 4—4 as shown in FIG. 2.
Figure 3:
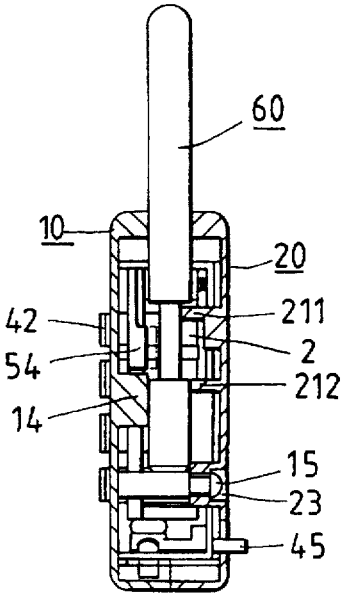
FIG. 3 shows a sectional view of a portion taken along the direction indicated by a line 3—3 as shown in FIG. 2.

As shown in FIGS. 3 and 4, if the numbered wheels 42 are not located correctly, the retaining portion 54 of the movable grid plate 50 is actuated by the locking mechanism 40 to engage the retaining portion 63 of the shackle 60, as shown by the imaginary line in FIG. 3. As a result, the shackle 60 can not be moved upwards and remains in a locked state. On the other hand, when the numbered wheels 42 are located correctly in accordance with a set series of numbers or letters, the retaining portion 54 of the movable grid plate 50 is actuated to move upwards to remain away from the retaining portion 63 of the shackle 60, as shown by the solid line in FIG. 3. As a result, the shackle 60 can be easily moved upwards until such time when the bottom of the retaining portion 63 is in contact with the retaining block 211 of the rear housing 20. As a result, the shackle 60 can not be separated from the housing 1 of the present invention. In the meantime, the hook portion 61 of the shackle 60 is disengaged with the recess 18 of the front housing 10 and the recess 27 of the rear housing 20 so as to remain in an unlocking state. When the shackle 60 is swiveled, the protuberance 64 of the shackle 60 is retained by the top of the front housing 10 and the rear housing 20, as shown by the imaginary line in FIG. 4. The shackle 60 can not be therefore detached from the housing 1 of the present invention.

The combination padlock of the present invention is devoid of the conventional pivoting pin or C-shaped retaining rings, which are replaced by the position restricting blocks 14, 212, the retaining block 211, and the retaining portion 63 of the present invention. In addition, the assembly of the numbered wheel set 2 of the present invention can be attained easily and rapidly by virtue of the fact that the locking mechanism 40 and the seat body 30 of the present invention are provided therebetween with the fastening pieces 48 of an inverted U-shaped construction.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A combination padlock comprising:

a housing composed of a front housing and a rear housing, said front housing and said rear housing engaged to each other and provided respectively and correspondingly with a receiving cell, a recess, a pivoting hole penetrating into said receiving cell, said receiving cell having in a bottom thereof a predetermined number of through holes;

a shackle having a body portion engageable with said pivoting holes of said housing, and a hook portion engageable with said recesses of said housing; and a numbered wheel set disposed in said receiving cells of said front housing and said rear housing, said numbered wheel set provided with a seat for mounting thereon a locking mechanism, said locking mechanism comprising a rotary shaft and a plurality of numbered wheels mounted on said rotary shaft such that each of said numbered wheels is capable of actuating a movable grid plate located thereunder for regulating an axial movement of said shackle along said pivoting holes of said housing;

wherein said body portion of said shackle has a retaining portion engageable with a retaining means of said movable grid plate;

wherein said receiving cell of said front housing is provided in a bottom thereof with a position restricting block opposite in location to said body portion of said shackle for confining the movement of said shackle;

wherein said receiving cell of said rear housing is provided in a bottom thereof with a position restricting block and a retaining block, said position restricting block corresponding in location to said body portion of said shackle for confining said shackle, said retaining block being engageable with said retaining portion of said body portion of said shackle at such time when said shackle is pulled upwards;

wherein said seat of said numbered wheel set is provided respectively in two side walls thereof with a shaft slot for receiving said rotary shaft of said locking mechanism, said shaft slots are provided respectively at two sides thereof with a connection slot; wherein two fastening pieces are provided respectively with two connection ribs and are fastened respectively with both ends of said rotary shaft such that said connection ribs of said two fastening pieces are engaged with said connection slots of said shaft slots of said numbered wheel set.

2. The combination padlock as defined in claim 1, wherein said pivoting holes of said front housing and said rear housing are provided respectively in an inner wall thereof with a slide slot; and wherein said body portion of said shackle is provided with a protuberance disposed slidably in said slide slot of said pivoting holes of said front housing and said rear housing.

* * * * *